US010772480B2

(12) United States Patent
Ponkshe et al.

(10) Patent No.: US 10,772,480 B2
(45) **Date of Patent: *Sep. 15, 2020**

(54) DISHWASHER WITH DOOR ASSEMBLY

(71) Applicant: Whirlpool Corporation, Benton Harbor, MI (US)

(72) Inventors: Mihir Suresh Ponkshe, Pune (IN); Michael E. Gatt, Saint Joseph, MI (US); Jonathan David Pugh, Benton Harbor, MI (US); Jayesh Prakash Borase, Pune (IN); Russikant Behera, Dhenkanal (IN); Darryl C. Bodine, Saint Joseph, MI (US); James W. Kendall, Mount Prospect, IL (US); Krzysztof Ploszaj, Dobrzykowice (PL)

(73) Assignee: Whirlpool Corporation, Benton Harbor, MI (US)

( * ) Notice: Subject to any disclaimer, the term of this patent is extended or adjusted under 35 U.S.C. 154(b) by 104 days.

This patent is subject to a terminal disclaimer.

(21) Appl. No.: 16/111,421

(22) Filed: Aug. 24, 2018

(65) Prior Publication Data

US 2020/0060509 A1 Feb. 27, 2020

(51) Int. Cl.
*A47L 15/00* (2006.01)
*A47L 15/42* (2006.01)

(52) U.S. Cl.
CPC ..... *A47L 15/4257* (2013.01); *A47L 15/4265* (2013.01); *A47L 15/4293* (2013.01)

(58) Field of Classification Search
CPC ..... A47L 15/4257; A47L 15/4265; A47L 15/4293; A47L 15/4261; A47L 15/4259; A47L 15/0049; G06F 3/0481; G06F 3/0488; Y10T 403/608
USPC ..... 312/326–329, 228, 228.1; 134/58 D
See application file for complete search history.

(56) References Cited

U.S. PATENT DOCUMENTS

| | | | | |
|---|---|---|---|---|
| 3,997,201 | A * | 12/1976 | DeSchaaf | A47L 15/4259 292/173 |
| 4,732,431 | A | 3/1988 | Mason | |
| 4,765,697 | A | 8/1988 | Garden et al. | |
| 5,806,942 | A | 9/1998 | Jenkins, Jr. et al. | |
| 6,527,315 | B2 | 3/2003 | Marks et al. | |
| 7,216,944 | B2 | 5/2007 | Oyler et al. | |
| D544,657 | S | 6/2007 | Jung et al. | |
| 7,371,984 | B2 | 5/2008 | Lee et al. | |
| 7,758,705 | B2 * | 7/2010 | Ahn | A47L 15/0049 134/102.1 |
| 8,740,320 | B2 | 6/2014 | Eng | |

(Continued)

FOREIGN PATENT DOCUMENTS

EP 2380479 A1 10/2011

*Primary Examiner* — Janet M Wilkens
(74) *Attorney, Agent, or Firm* — McGarry Bair PC

(57) ABSTRACT

A household appliance includes a cabinet defining a chamber with an access opening. A door assembly is movably mounted to the cabinet to selectively open and close the access opening. The door assembly includes a door panel defining a front surface and side surfaces. A door panel flange extends inwardly from a rear edge of the side surface. A single-piece console defines a top surface, a front surface, and a rear attachment surface, the top surface substantially perpendicular to the front surface. A rotatable spacer is positioned between the rear attachment surface of the single-piece console and the door panel flange.

20 Claims, 7 Drawing Sheets

(56) References Cited

U.S. PATENT DOCUMENTS

| | | | | |
|---|---|---|---|---|
| 9,775,489 | B1 * | 10/2017 | Ponkshe | A47L 15/4265 |
| 10,478,040 | B1 * | 11/2019 | Ford, Jr. | A47L 15/4257 |
| 2011/0141103 | A1 | 6/2011 | Cohen et al. | |
| 2012/0111366 | A1 * | 5/2012 | Baldwin | A47L 15/4259<br>134/18 |
| 2015/0192288 | A1 * | 7/2015 | Kim | F21V 33/0044<br>362/253 |
| 2018/0135333 | A1 * | 5/2018 | Viswanathan | E05B 1/0084 |
| 2019/0059693 | A1 * | 2/2019 | Kendall | A47L 15/4261 |

* cited by examiner

DISHWASHER WITH DOOR ASSEMBLY

BACKGROUND

Contemporary automatic dishwashers for use in a typical household include a tub that can have an open front and at least partially defines a treating chamber into which items, such as kitchenware, glassware, and the like, can be placed to undergo a washing operation. At least one rack or basket for supporting soiled dishes can be provided within the tub. A spraying system with multiple sprayers can be provided for recirculating liquid throughout the tub to remove soils from the dishes.

The dishwasher can be provided with a door assembly, which can be pivotally mounted to the tub and that selectively closes the open front. The door assembly can include a panel defining a door front. A console can be included in the door assembly and can define or be coupled with various features for user interaction with the dishwasher. Such features can include, but are not limited to, a user interface, control buttons, an external handle, a pocket handle, and a door top surface. Such a console can be provided in at least two parts. In the case that the console is provided as two parts, there is often a pocket panel that is adhered to the front panel, and a console cap or fascia assembly that encloses the door from the top or can be provided as a user interface along the door top surface. This results in the need to use adhesive to join the two portions of the console, as well as to join the console pieces to the door front panel. This results in an assembly process requiring the use of adhesive, an added cost, as well as increased time and complexity.

BRIEF SUMMARY

An aspect of the present disclosure relates to a household appliance comprising a cabinet defining a chamber with an access opening and a door assembly movably mounted to the cabinet to selectively open/close the access opening, the door assembly comprising a door panel defining a front surface and side surfaces, with a door panel flange extending inwardly from a rear edge of the side surface, a single-piece console defining a top surface, a front surface, and a rear attachment surface adjacent the door panel flange, the top surface substantially perpendicular to the front surface, and a rotatable spacer positioned between the rear attachment surface of the single-piece console and the door panel flange, wherein the rotatable spacer is configured to rotate from a first initial installation position to a second, fully installed position during assembly of the door assembly.

Another aspect of the present disclosure relates to a household appliance comprising a cabinet defining a chamber with an access opening and a door assembly movably mounted to the cabinet to selectively open/close the access opening, the door assembly comprising a door panel defining a front surface and an opening within the front surface, and a single-piece console defining a top surface and a front surface substantially perpendicular to the top surface, the front surface at least partially received within the opening, wherein the single-piece console further comprises a U-shaped channel at a lower edge of the single-piece console that is configured to receive the opening of the door panel within the U-shaped channel.

Yet another aspect of the present disclosure relates to a household appliance comprising a cabinet defining a chamber with an access opening, a door assembly movably mounted to the cabinet to selectively open/close the access opening and having a front panel defining an opening, a single-piece console defining a front surface and a top surface, the top surface substantially perpendicular to the front surface, the front surface at least partially received within the opening, wherein the single-piece console is configured to receive a user interface at either the front surface or the top surface.

DETAILED DESCRIPTION

Figure 1:
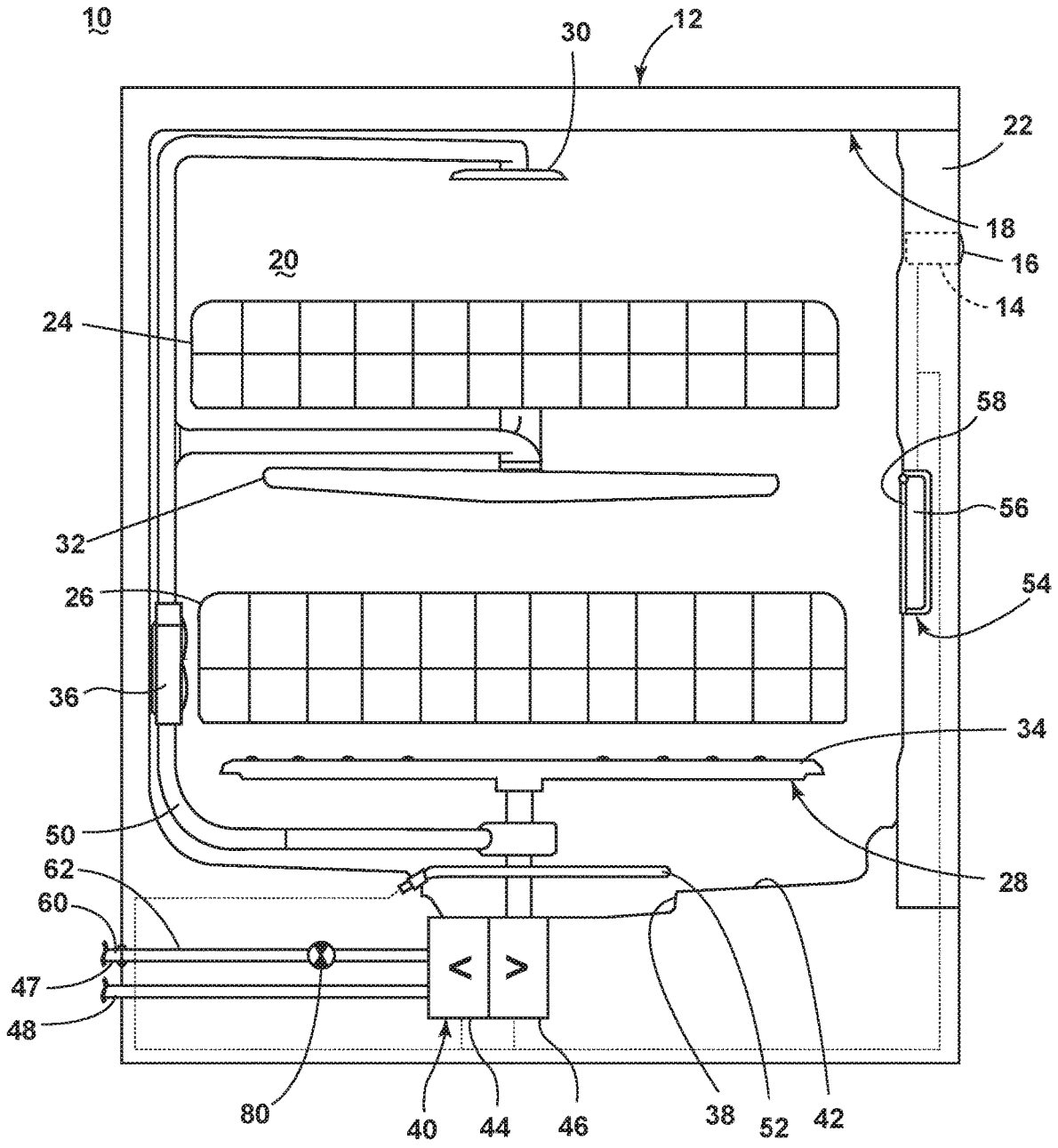
FIG. 1 illustrates a schematic, side view of a dishwasher according to an aspect of the present disclosure.

FIG. 1 is a schematic, side view of a dishwasher 10 for treating dishes according to an automatic cycle of operation, according to an aspect of the present disclosure. In FIG. 1, the dishwasher 10 includes a chassis 12 defining an interior. Depending on whether the dishwasher 10 is a stand-alone or built-in dishwasher, the chassis 12 can be a frame with or without panels attached, respectively. The dishwasher 10 shares many features of a conventional automatic dishwasher, which will not be described in detail herein except as necessary for a complete understanding of aspects of the disclosure. While aspects of the disclosure are described in terms of a conventional dishwashing unit, it can also be implemented in other types of dishwashing units, such as in-sink dishwashers, multi-tub dishwashers, or drawer-type dishwashers, as well as dishwashers having varying widths, sizes, and capacities.

A controller 14 can be located within the chassis 12 and can be operably coupled with various components of the dishwasher 10 to implement one or more cycles of operation. A control panel or user interface 16 can be provided on the dishwasher 10 and coupled with the controller 14. The user interface 16 can be provided on the chassis 12 or on a door assembly 22 and can include operational controls such as dials, lights, switches, and displays enabling a user to input commands, such as a cycle of operation, to the controller 14 and receive information about the selected cycle of operation.

A tub 18 is located within the interior of and mounted to the chassis 12 and at least partially defines a treating chamber 20 with an access opening in the form of an open face. A cover, illustrated as the door assembly 22, can be hingedly or pivotally mounted to the chassis 12 and can selectively move between an opened position, wherein the user can access the treating chamber 20, and a closed position, as shown in FIG. 1, wherein the door assembly 22 covers or closes the open face of the treating chamber 20.

Dish holders in the form of upper and lower racks 24, 26 are located within the treating chamber 20 and receive dishes for being treated. The racks 24, 26 define an interior and are mounted for slidable movement in and out of the treating chamber 20 for ease of loading and unloading. As used in this description, the term "dish(es)" is intended to be generic to any item, single or plural, that may be treated in the dishwasher 10, including, without limitation; dishes, plates, pots, bowls, pans, glassware, silverware, and other utensils. While not shown, additional dish holders, such as a silverware basket on the interior of the door assembly 22 or a third level rack above the upper rack 24 can also be provided.

A spraying system 28 can be provided for spraying liquid into the treating chamber 20 and is illustrated in the form of an upper sprayer 30, a mid-level sprayer 32, a lower sprayer 34, and a spray manifold 36. The upper sprayer 30 can be located above the upper rack 24 and is illustrated as a fixed spray nozzle that sprays liquid downwardly within the treating chamber 20. Mid-level sprayer 32 and lower sprayer 34 are located beneath upper rack 24 and lower rack 26, respectively, and are illustrated as rotating spray arms. The mid-level sprayer 32 can provide a liquid spray upwardly through the bottom of the upper rack 24. The lower sprayer 34 can provide a liquid spray upwardly through the bottom of the lower rack 26. The mid-level sprayer 32 can optionally also provide a liquid spray downwardly onto the lower rack 26, but for purposes of simplification, this will not be illustrated herein.

The spray manifold 36 can be fixedly mounted to the tub 18 adjacent to the lower rack 26 and can provide a liquid spray laterally through a side of the lower rack 26. The spray manifold 36 is not limited to this position; rather, the spray manifold 36 can be located in any suitable part of the treating chamber 20. While not illustrated herein, the spray manifold 36 can include multiple spray nozzles having apertures configured to spray wash liquid towards the lower rack 26. The spray nozzles can be fixed or rotatable with respect to the tub 18. Suitable spray manifolds are set forth in detail in U.S. Pat. No. 7,445,013, filed Jun. 17, 2003, and titled "Multiple Wash Zone Dishwasher," and U.S. Pat. No. 7,523,758, filed Dec. 30, 2004, and titled "Dishwasher Having Rotating Zone Wash Sprayer," both of which are incorporated herein by reference in their entirety. Instead of or in addition to the spray manifold 36 provided on the rear wall, nozzles can be provided on the right and left side walls of the tub 18.

A liquid recirculation system can be provided for recirculating liquid from the treating chamber 20 to the spraying system 28. The recirculation system can include a sump 38 and a pump assembly 40. The sump 38 collects the liquid sprayed in the treating chamber 20 and can be formed by a sloped or recess portion of a bottom wall 42 of the tub 18. The pump assembly 40 can include both a drain pump 44 and a recirculation pump 46.

The liquid recirculation system can also be fluidly coupled with a water supply line 47 for receiving fresh water from a water supply source, such as a household water supply, as well as a water supply circuit. The water supply circuit comprises a household inlet fitting 60, which is carried by the chassis 12, a conduit 62 that fluidly couples the inlet fitting 60 to the tub 18, and an actuatable valve 80. The actuatable valve 80 selectively controls the flow of liquid through the conduit 62, allowing the flow of liquid from the conduit 62 into the tub 18 when the actuatable valve 80 is in an opened position, and preventing the flow of liquid from the conduit 62 into the tub 18 when the actuatable valve 80 is in a closed position.

The drain pump 44 can draw liquid from the sump 38 and pump the liquid out of the dishwasher 10 to a household drain line 48. The recirculation pump 46 can draw liquid from the sump 38 and pump the liquid through the spray system 28 to supply liquid into the treating chamber 20 through a supply tube 50 to one or more of the sprayers 30, 32, 34, 36. In this manner, liquid can circulate from the sump 38 through the liquid recirculation system to the spray system 28 and back to the sump 38 to define a liquid recirculation circuit or flow path.

While the pump assembly 40 is illustrated as having separate drain and recirculation pumps 44, 46 in an alternative aspect, the pump assembly 40 can include a single pump configured to selectively supply wash liquid to either the spraying system 28 or the drain line 48, such as by configuring the pump to rotate in opposite directions, or by providing a suitable valve system.

A heating system having a heater 52 can be located within or near the sump 38 for heating liquid contained in the sump 38. The heater 52 can also heat air contained in the treating chamber 20. Alternatively, a separate heating element (not shown) can be provided for heating the air circulated through the treating chamber 20. A filtering system (not shown) can be fluidly coupled with the recirculation flow path for filtering the recirculated liquid.

A user-accessible dispensing system can be provided for storing and dispensing one or more treating chemistries to the treating chamber 20. As shown herein, the user-accessible dispensing system can include a dispenser 54 mounted on an inside surface of the door assembly 22 such that the dispenser 54 is disposed in the treating chamber 20 when the door assembly 22 is in the closed position. The dispenser 54 is configured to dispense treating chemistry to the dishes within the treating chamber 20. The dispenser 54 can have one or more compartments 56 closed by a dispenser door 58 on the inner surface of the door assembly 22. The dispenser 54 can be a single use dispenser which holds a single dose of treating chemistry, a bulk dispenser which holds a bulk supply of treating chemistry and which is adapted to dispense a dose of treating chemistry from the bulk supply during a cycle of operation, or a combination of both a single use and bulk dispenser.

The dispenser 54 can further be configured to hold multiple different treating chemistries. For example, the dispenser 54 can have multiple compartments defining different chambers in which treating chemistries can be held. While shown as being disposed on the door assembly 22, other locations of the dispenser 54 are possible. However, the dispenser 54 is positioned to be accessed by the user for refilling of the dispenser 54, whether it is necessary to refill the dispenser 54 before each cycle (i.e. for a single user dispenser) or only periodically (i.e. for a bulk dispenser).

Figure 2:
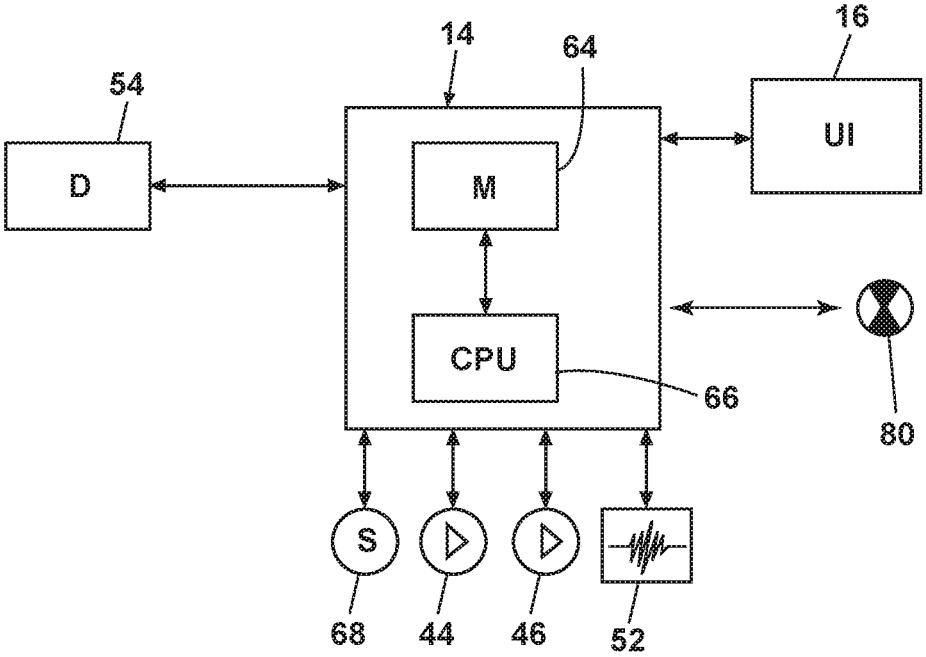
FIG. 2 illustrates a schematic view of a controller for use with the dishwasher of FIG. 1.

FIG. 2 is a schematic view of the controller 14 of the dishwasher 10 of FIG. 1. As illustrated schematically in FIG. 2, the controller 14 can be coupled with the heater 52 for heating the wash liquid during a cycle of operation, the drain pump 44 for draining liquid from the treating chamber 20, the recirculation pump 46 for recirculating the wash liquid during the cycle of operation, the user-accessible dispenser 54 for selectively dispensing treating chemistry to the treating chamber 20, and the actuatable valve 80 to selectively control the flow of liquid through the conduit 62 into the tub 18.

The controller 14 can be provided with a memory 64 and a central processing unit (CPU) 66. The memory 64 can be used for storing control software that can be executed by the CPU 66 in completing a cycle of operation using the dishwasher 10 and any additional software. For example, the memory 64 can store one or more pre-programmed cycles of operation that can be selected by a user and completed by the dishwasher 10. A cycle of operation for the dishwasher 10 can include one or more of the following steps: a wash step, a rinse step, and a drying step. The wash step can further include a pre-wash step and a main wash step. The rinse step can also include multiple steps such as one or more additional rinsing steps performed in addition to a first rinsing. The amounts of water and/or rinse aid used during each of the multiple rinse steps can be varied. The drying step can have a non-heated drying step (so called "air only"), a heated drying step or a combination thereof. These multiple steps can also be performed by the dishwasher 10 in any desired combination.

The controller 14 can also receive input from one or more sensors 68. Non-limiting examples of sensors 68 that can be communicably coupled with the controller 14 include a temperature sensor and turbidity sensor to determine the soil load associated with a selected grouping of dishes, such as the dishes associated with a particular area of the treating chamber 20.

Figure 3:
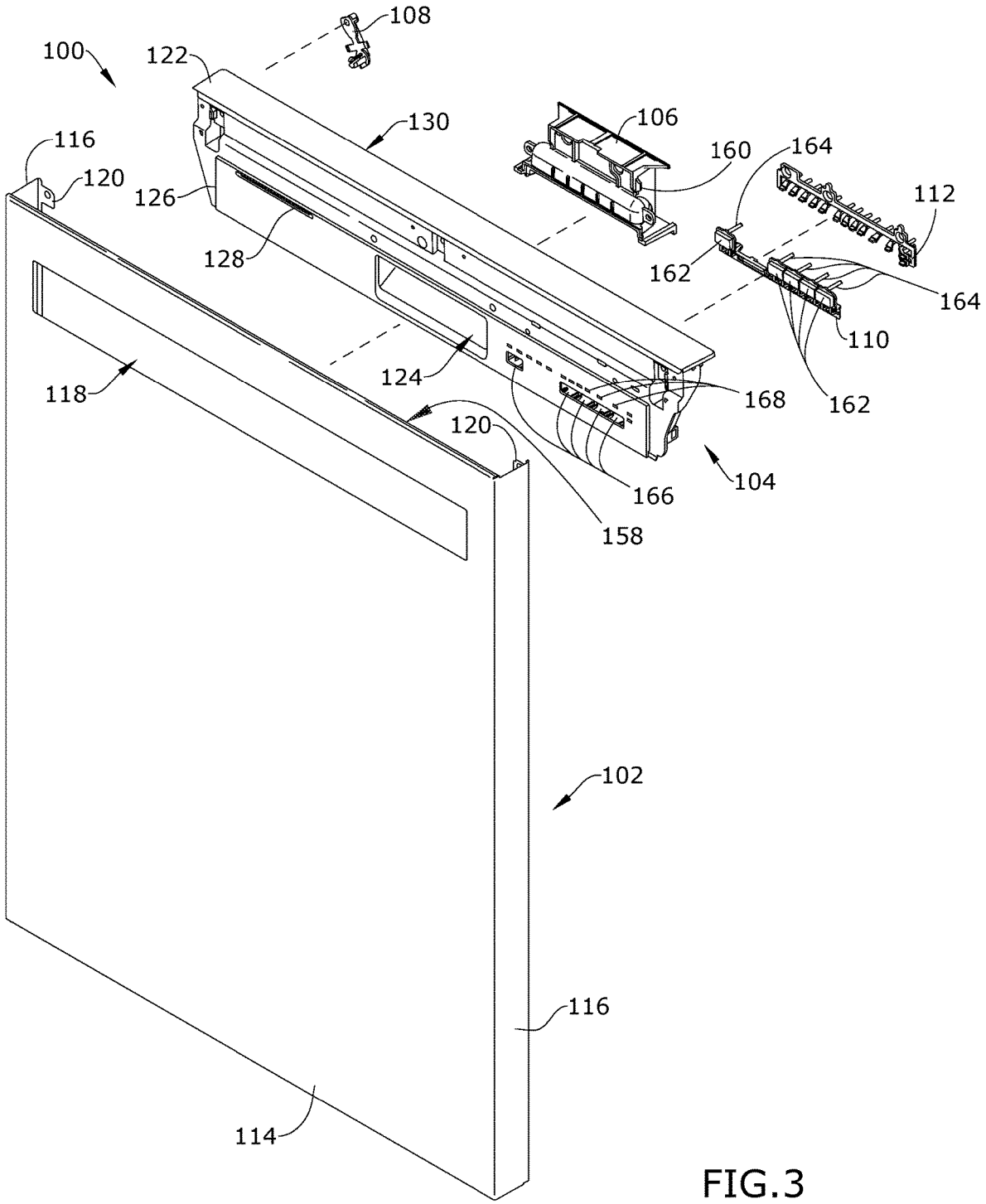
FIG. 3 illustrates an exploded perspective view of a door assembly for use with the dishwasher of FIG. 1 in accordance with an aspect of the present disclosure.

Turning now to FIG. 3, an exploded perspective view of a door panel assembly 100 that forms portions of the door assembly 22 of the dishwasher 10 is illustrated. While not illustrated, the door assembly 22 can also include an interior portion confronting the treating chamber 20 when the door assembly 22 is in the closed position, the interior portion including, by way of non-limiting example, the dispenser 54. The door panel assembly 100 comprises a front door panel 102, a single-piece console 104, a handle 106, at least one rotatable spacer 108, a button tree 110, and a light assembly 112.

Figure 5:
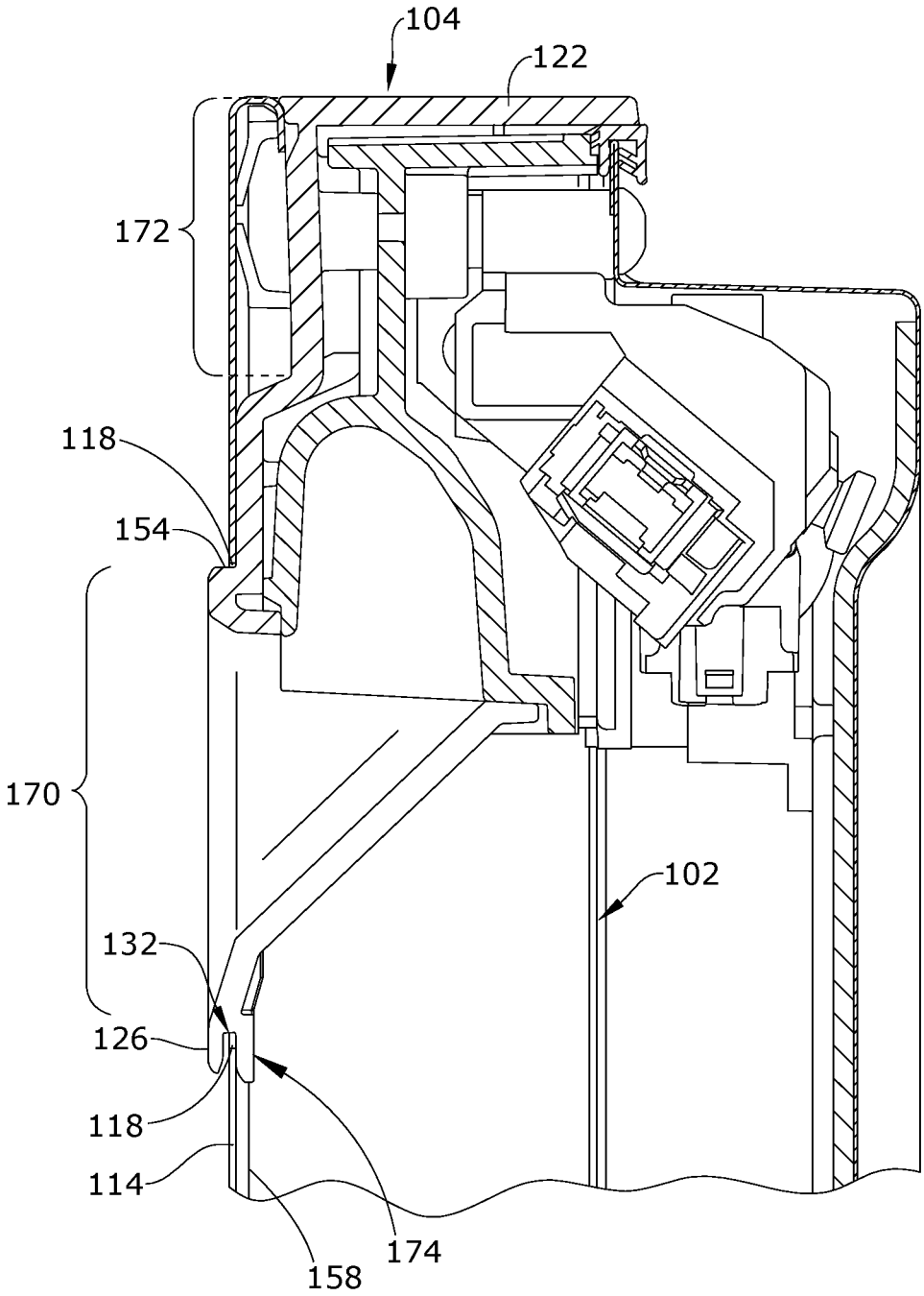
FIG. 5 illustrates a side cross-sectional view of an upper portion the door assembly of FIG. 3.

The front door panel 102 defines a door panel front surface 114, side surfaces 116, and a rear surface 158 (FIG. 5). The side surfaces 116 are substantially perpendicular to the front surface 114. At least one door panel flange 120 can extend from the side surfaces 116, such that the door panel flange 120 is generally perpendicular to the side surfaces 116 and generally parallel to and spaced from the front surface 114. Door panel flanges 120 on each of the side surfaces 116 extend inwardly toward each other. A console opening 118 can be provided within and defined by the front surface 114. While the console opening 118 is illustrated herein as having a width less than the total width of the front surface 114 and positioned at an upper portion of the front surface 114, it will be understood that the console opening 118 can have any suitable shape and position, including that it can extend the entire width of the front surface 114.

The single-piece console 104 is defined by an integral or monolithic piece. The single-piece console 104 includes a panel on which there are inputs for controlling the dishwasher 10 or outputs for displaying status information for the dishwasher 10. More specifically, a console front surface 126 and a top surface 122 that is substantially perpendicular to the console front surface 126 are included in the single-piece console 104. The top surface 122 also forms the upper or top surface 122 for the door assembly 22.

At least a portion of the console front surface 126 is configured to be received within the console opening 118. The portion of the console front surface 126 received within the console opening 118 can be provided with a plurality of features. Non-limiting examples of such features include a pocket portion, illustrated herein as a pocket 124, through which the handle 106 can be reached, a vent 128, buttons, switches, or other inputs, printed graphics, which can be molded in or decorated in, decorative inserts, and a user interface. These features can be molded or formed into or with the single-piece console 104 or can be coupled with the single-piece console 104. The decorative insert 156 (FIG. 4) can be included on or otherwise mounted to the console front surface 126. It will be understood that the buttons can be any suitable control setting device, non-limiting examples of which include switches, such as rocker switches, or rotating knobs or dials. While the pocket portion is illustrated herein as a pocket 124 through which the handle 106 can be reached, it will be understood that the handle 106 can instead be coupled to the single-piece console 104 without the need for a pocket 124, such as by the use of a pull knob.

At least one rotatable spacer 108 is included within the door panel assembly 100. In an exemplary aspect, two rotatable spacers 108 are provided, one at each side of the door panel assembly 100. When the door panel assembly 100 is in an assembled condition, the rotatable spacer 108 is provided between a rear surface 130 of the single-piece console 104 and the front door panel 102, specifically the door panel flange 120. It will be understood that the rotatable spacer 108 can also be provided as a slide-in, separate, or removable spacer part.

When the door panel assembly 100 is in an assembled condition, the handle 106 is positioned to align with the pocket 124 on the console front surface 126, such that a user can reach into the pocket 124 to contact the handle 106. The handle 106 can be a handle 106 for providing a grip for a user, having no reciprocating latch elements, or the handle 106 can include movable components, such as a latch or lock for the door assembly 22. Regardless of the type of handle 106, a user can utilize the handle to move the door assembly 22 between opened and closed positions, selectively allowing access to the treating chamber 20. The handle 106 can be coupled to the single-piece console 104 by any suitable mechanism including a snap attachment mechanism 160, as illustrated.

The button tree 110 can be received by or coupled to the single-piece console 104. Specifically, the single-piece console 104 can include openings or apertures 166 defined by the console front surface 126, such that buttons 162 of the button tree 110 are received within the apertures 166 and presented to a user for interaction with the dishwasher 10. While the button tree 110 is illustrated herein as a single monolithic piece connecting a plurality of buttons 162, it will be understood that individual, non-connected buttons can also be contemplated. The button tree 110 can further include button stems 164 that provide a mechanical coupling between the buttons 162 presented to the user and switches coupled to the controller 14, such that a user depressing the button 162 causes the button stem 164 to be correspondingly depressed to contact switches on the controller 14.

The light assembly 112 can couple to the single-piece console 104 for illuminating buttons displayed to a user, or illuminating indicators, such as status displays. Specifically, the console front surface 126 can include illumination apertures 168 within which the light sources of the light assembly 112 can be received for displaying illumination to the user. The illumination apertures 168 can be provided as through-openings in the console front surface 126, or could be transparent portions of the console front surface 126 such that light is transmitted through the illumination apertures 168. The light assembly 112 can be any suitable source or structure for light emission, including but not limited to LEDs or an LED array that is coupled to the controller 14 in order to communicate status or display information to the user.

Figure 4:
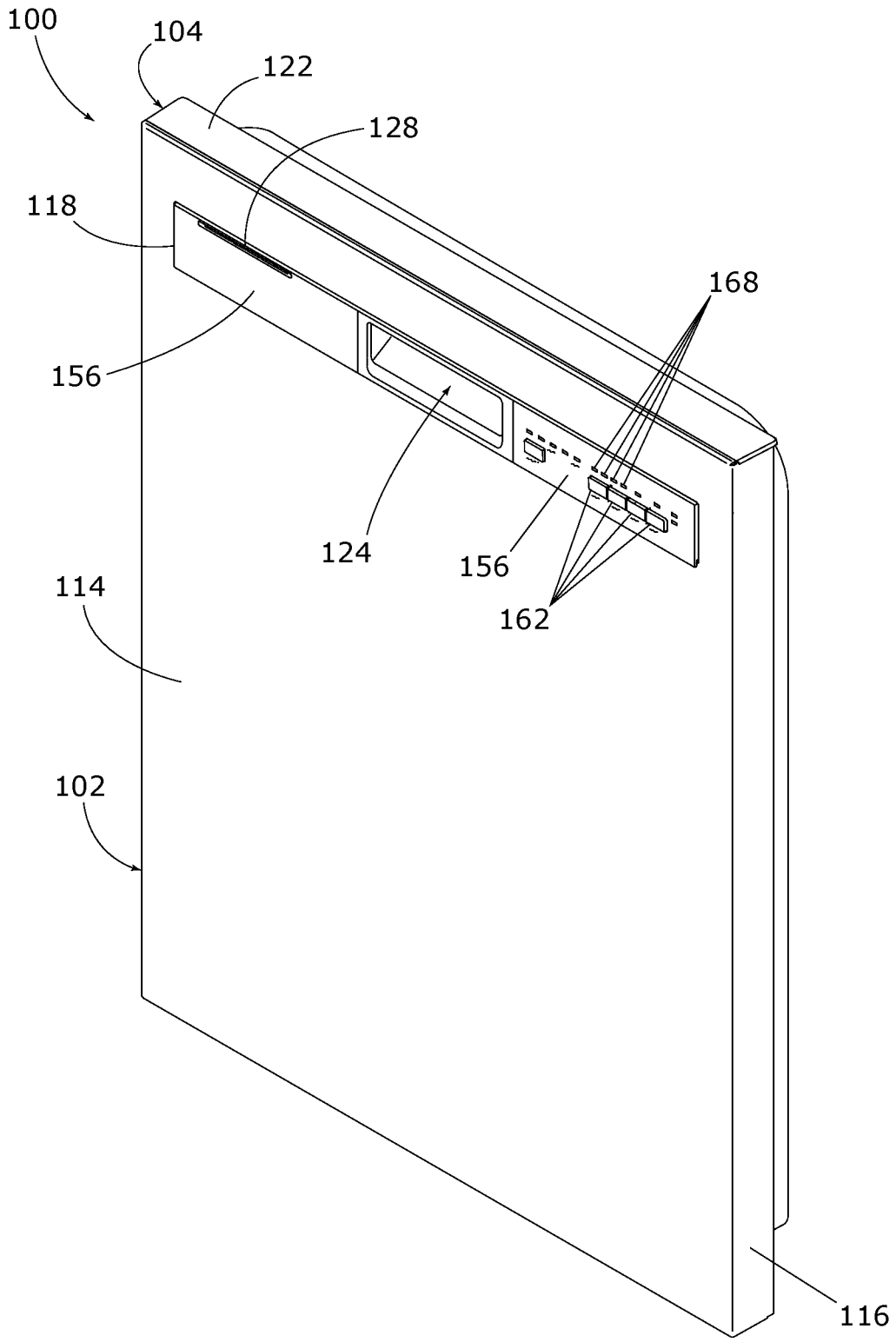
FIG. 4 illustrates a front perspective view of the door assembly of FIG. 3 in an assembled form.

FIG. 4 illustrates the door panel assembly 100 in the assembled condition, with the decorative inserts 156, vent 128, pocket 124, buttons 162, and light assembly 112 in place. The vent 128 can be any suitable structure to allow the flow of air between the treating chamber 20 and the door panel assembly 100, specifically to the console front surface 126. While the vent 128 is illustrated herein as a plurality of fixed openings to allow air flow, it will be understood that the vent 128 can also include active components, such as a fan, blower, or motor assembly coupled to the vent 128. While the button tree 110 and light assembly 112 are illustrated herein as being coupled to the console front surface 126, it will be understood that the user interface, including the button tree 110 and the light assembly 112 can also be provided at the top surface 122 of the single-piece console 104.

FIG. 5 illustrates an enlarged cross-sectional view of the single-piece console 104 mounted in the front door panel 102. A first portion 170 of the console front surface 126 extends through the console opening 118. It can be more easily seen from the cross-section that the console front surface 126 is contoured and that the first portion 170 that extends through the console opening 118 projects from a remainder of the console front surface 126. A second portion 172 of the console front surface 126 is recessed to accommodate a project of an upper portion of the front door panel 102.

A lower edge 174 adjacent the console front surface 126 defines an inverted U-shaped channel 132. The U-shaped channel 132 is configured to receive the front surface 114 of the front door panel 102, where the front surface 114 forms the console opening 118. By way of non-limiting example, the U-shaped channel 132 can define a horizontal width of 1.4 millimeters and a vertical height of 3 millimeters. The receiving of the front surface 114 at the console opening 118 within the U-shaped channel 132 robustly couples the single-piece console 104 with the front door panel 102 so that undesired movement between the two pieces is restricted. The console front surface 126 can further form a protruding rib or protruding edge 154 that corresponds to and is received by the console opening 118, for example by a snap-in attachment, to further secure the single-piece console 104 to the front door panel 102 in the appropriate alignment. The front door panel 102 can also include shapes or features to facilitate coupling with the single-piece console 104, such as by securing, an interference fit, or a snap-in attachment. The top surface 122 of the single-piece console 104 can also be shaped to have a fit complementary to the front door panel 102, such as at the second portion 172, and also by interaction with a centering rib 152, as discussed in detail with respect to FIG. 6.

Figure 6:
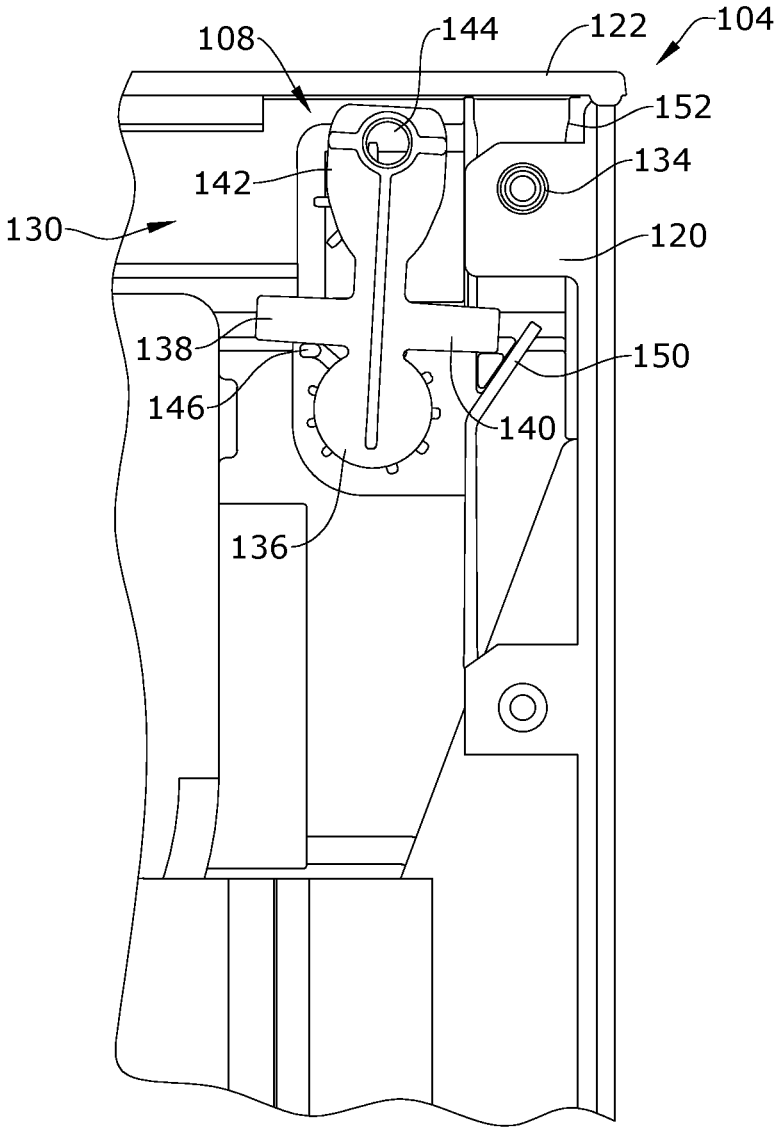
FIG. 6 illustrates a rear view of an upper corner portion of the door assembly of FIG. 3 having a spacer in accordance with an aspect of the present disclosure, the spacer shown in unlocked position.

FIG. 6 illustrates in more detail the rotatable spacer 108 in a first or initial installation position wherein the rotatable spacer 108 is substantially vertical and does not contact the door panel flange 120. The rotatable spacer 108 comprises a pivot portion 136 at a lower end. The rotatable spacer 108 further comprises an inner arm 138 and an outer arm 140. Each of the inner arm 138 and the outer arm 140 extend outwardly from the sides of the rotatable spacer 108. Above the inner arm 138 and the outer arm 140 is a fastener portion 142 of the rotatable spacer 108, which further defines a fastener opening 144. At least one centering rib 152 is also formed by the single-piece console 104 to contact the side surfaces 116 of the front door panel 102 to ensure the single-piece console 104 is centered with the front door panel 102.

The pivot portion 136 of the rotatable spacer 108 is coupled with the rear surface 130 of the single-piece console 104. The rear surface 130 defines an inner arm rib 146 on which the inner arm 138 of the rotatable spacer 108 can rest when the rotatable spacer 108 occupies the initial installation position. It will be understood that the inner arm 138 need not rest on or be supported by the inner arm rib 146 in the initial installation position. Rather, the inner arm 138 can be positioned slightly above the inner arm rib 146, such that the inner arm rib 146 prevents further inward rotational motion of the rotatable spacer 108. A spacing rib 150 is also defined by the rear surface 130. The rotatable spacer 108 is not in contact with the spacing rib 150 in the initial installation position.

Figure 7:
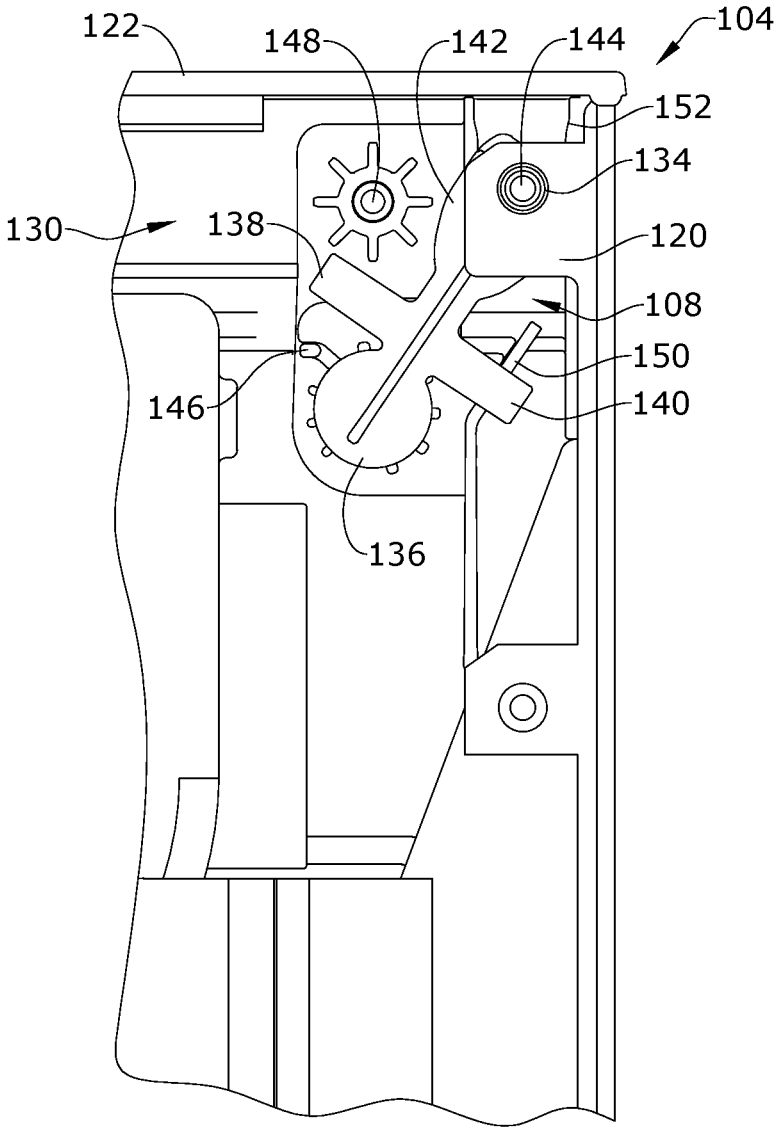
FIG. 7 illustrates the rear view of FIG. 6 with the spacer shown in the locked position.

FIG. 7 illustrates the view of FIG. 6, but with the rotatable spacer 108 rotated outwardly to a second or fully installed position, about the pivot portion 136, where the rotatable spacer 108 is between the rear surface 130 of the single-piece console 104 and the door panel flange 120. In the fully installed position, the inner arm 138 is no longer in contact with the inner arm rib 146. The outer arm 140 overlies and extends behind the spacing rib 150. In an exemplary aspect, the outer arm 140 can include a snap feature that couples to the spacing rib 150 in order to prevent the rotatable spacer 108 from rotating out of the fully installed position. The spacing rib 150 can resiliently bear against the outer arm 140, providing a pressure to prevent undesired movement between the single-piece console 104 and the front door panel 102.

In the fully installed position, the fastener portion 142 of the rotatable spacer 108 is positioned between the rear surface 130 and the door panel flange 120. The fastener opening 144 is at least partially aligned with a flange fastener opening 134, which is defined by the door panel flange 120. When the rotatable spacer 108 is in the fully installed position, a fastener can pass through the flange fastener opening 134 and the fastener opening 144 to couple the single-piece console 104 and the front door panel 102 together. Any suitable type of fastener can be used, non-limiting examples of which include a screw, a plug, a snap-in feature, or a heat stake. Further, when the rotatable spacer 108 is in the fully installed position, a barrel nut opening 148 on the rear surface 130 is exposed for attachment of additional components of the door assembly 22.

It will be understood that the door panel assembly 100 can be assembled in any suitable manner. By way of non-limiting example, the handle 106 can first be coupled to the single-piece console 104 via a snap-in attachment mechanism 160. Next, the light assembly 112 and the button tree 110 are coupled to the single-piece console 104, which can use a fastener or a snap-in attachment. The at least one rotatable spacer 108 is then coupled to the rear surface 130. While the rotatable spacer 108 is illustrated herein as being a separate piece that is coupled to the rear surface 130, it will also be understood that the rotatable spacer 108 can be formed with the rear surface 130 such that it is rotatable to the fully installed position, or the rotatable spacer 108 could be molded to the single-piece console 104 at another location, where it could be configured to be broken off or removed from the other location for attachment to the rear surface 130 at the time of installation.

The single-piece console 104 can then be coupled to the front door panel 102. The single-piece console 104 is aligned with the console opening 118, such that the U-shaped channel 132 receives the front surface 114 of the front door panel 102. The protruding edge 154 of the single-piece console 104 can then be snapped into place within the console opening 118. Rotation of the rotatable spacer 108 from the initial installation position to the fully installed position allows for the insertion of a fastener to join the single-piece console 104 to the door panel flange 120.

The aspects described herein can be used to provide a single-piece console for use within a door panel assembly that simplifies and improves the installation and assembly process. While previous conventional approaches required the use of adhesive to form the console from more than one piece, resulting in increased cost, time, and complexity of assembly, the single-piece console of the present disclosure is ready for easy installation within the door panel assembly. The single-piece console also provides flexibility in manufacturing such that the same door panel piece can be used with the single-piece console whether it is desired for the user interface to be on the front surface or the top surface of the single-piece console. When the user interface is desired on the top panel, corresponding apertures for lights and puts can be included at the top surface and button trees and light sources can be attached to the top surface. Further, the inclusion of the rotatable spacer provides improved robustness to the door panel assembly and ensures proper installation. By having the rotatable spacer block the barrel nut opening in the initial installation position, it is ensured that the spacer must be rotated to the fully installed position before assembly of the door assembly can be completed.

It will also be understood that various changes and/or modifications can be made without departing from the spirit of the present disclosure. By way of non-limiting example, although the present disclosure is described for use with a door assembly pivotable about a horizontal axis, it will be recognized that the door assembly can be employed with various constructions, including door assemblies pivotable about a vertical axis and/or door assemblies for drawer-style dishwashers.

To the extent not already described, the different features and structures may be used in combination with each other as desired. That one feature may not be illustrated in all of the aspects of the disclosure is not meant to be construed that it cannot be, but is done for brevity of description. Thus, the various features of the different aspects of the disclosure may be mixed and matched as desired to form new aspects, whether or not the new aspects are expressly described.

While the aspects of the disclosure have been specifically described in connection with certain specific aspects thereof, it is to be understood that this is by way of illustration and not of limitation. Reasonable variation and modification are possible within the scope of the forgoing disclosure and drawings without departing from the spirit of the disclosure which is defined in the appended claims.

What is claimed is:

1. A household appliance comprising:

a cabinet defining a chamber with an access opening; and a door assembly movably mounted to the cabinet to selectively open/close the access opening, the door assembly comprising:

a door panel defining a door panel front surface and side surfaces, with a door panel flange extending inwardly from a rear edge of at least one of the side surfaces;

a single-piece console defining a top surface, a console front surface, and a rear attachment surface adjacent the door panel flange, the top surface substantially perpendicular to the console front surface; and a rotatable spacer positioned between the rear attachment surface of the single-piece console and the door panel flange;

wherein the rotatable spacer is configured to rotate from a first initial installation position to a second, fully installed position during assembly of the door assembly.

2. The household appliance of claim 1 wherein the single-piece console defines a barrel nut opening and the rotatable spacer prevents access to the barrel nut opening in the first initial installation position.

3. The household appliance of claim 1 wherein the rotatable spacer defines a fastener opening and the door panel flange defines a flange fastener opening.

4. The household appliance of claim 3 wherein the fastener opening and the flange fastener opening are aligned in the second, fully installed position for insertion of a fastener.

5. The household appliance of claim 1 wherein the single-piece console further defines a rib, the rib preventing further inward rotation of the rotatable spacer.

6. The household appliance of claim 1 wherein the single-piece console further defines a spacing rib.

7. The household appliance of claim 6 wherein the rotatable spacer bears against the spacing rib in the second, fully installed position to prevent the rotatable spacer from rotating out of the second, fully installed position.

8. The household appliance of claim 1 wherein the console front surface comprises at least one of a button, a printed graphic, a decorative insert, and a vent opening.

9. The household appliance of claim 1 wherein the door panel front surface includes an opening and the single-piece console further comprises a U-shaped channel at a lower edge of the single-piece console that is configured to receive the opening of the door panel front surface within the U-shaped channel.

10. The household appliance of claim 9 wherein the single-piece console further comprises a protruding rib that is received within the opening and forms a snap-in attachment with the opening.

11. The household appliance of claim 1 wherein the door panel front surface includes an opening, the console front surface at least partially received within the opening, and the single-piece console configured to receive a user interface at either the consu, front surface or the top surface.

12. A household appliance comprising:

a cabinet defining a chamber with an access opening; and a door assembly movably mounted to the cabinet to selectively open/close the access opening, the door assembly comprising:

a door panel defining a door panel front surface and an opening within the door panel front surface; and a single-piece console defining a top surface and a console front surface substantially perpendicular to the top surface, the console front surface at least partially received within the opening and having at least a portion of the console front surface that extends through the opening;

wherein the single-piece console further comprises a U-shaped channel at a lower edge of the single-piece console that is configured to receive the door panel front surface defining the opening within the U-shaped channel.

13. The household appliance of claim 12 wherein the single-piece console further comprises a protruding rib, the protruding rib received within the opening.

14. The household appliance of claim 13 wherein the protruding rib forms a snap-in attachment with the opening.

15. The household appliance of claim 12 wherein the door panel further defines side surfaces and the single-piece console further defines at least one centering rib for centering the single-piece console between the side surfaces.

16. A household appliance comprising:

a cabinet defining a chamber with an access opening;

a door assembly movably mounted to the cabinet to selectively open/close the access opening and having a front panel defining an opening; and a single-piece console defining a console front surface and a top surface, the top surface substantially perpendicular to the console front surface, the console front surface at least partially received within the opening and having at least a portion of the console front surface that extends through the opening;

wherein the single-piece console is configured to receive a user interface at either the console front surface or the top surface.

17. The household appliance of claim 16 wherein the top surface of the single-piece console forms an upper surface of the door assembly.

18. The household appliance of claim 16 wherein the console front surface comprises a pocket portion, the pocket portion forming a pocket opening in the single-piece console into which a user can reach.

19. The household appliance of claim 18 wherein the pocket portion is coupled with a handle that a user can access through the pocket opening for moving the door assembly to selectively open/close the access opening.

20. The household appliance of claim 16 wherein the console front surface comprises at least one of a button, a printed graphic, a decorative insert, and a vent opening.

* * * * *